US006491575B2

(12) United States Patent
Sarantitis

(10) Patent No.: US 6,491,575 B2
(45) Date of Patent: Dec. 10, 2002

(54) TOOL FOR THE REMOVAL OF PAINT-LIKE MATERIALS FROM WORK SURFACES

(76) Inventor: Andreas Sarantitis, 327 Lilac La., Carlstadt, NJ (US) 07072

( * ) Notice: Subject to any disclaimer, the term of this patent is extended or adjusted under 35 U.S.C. 154(b) by 0 days.

(21) Appl. No.: 09/872,866

(22) Filed: Jun. 4, 2001

(65) Prior Publication Data

US 2002/0115396 A1 Aug. 22, 2002

Related U.S. Application Data

(63) Continuation-in-part of application No. 09/315,832, filed on May 21, 1999, now abandoned, which is a continuation-in-part of application No. 08/888,275, filed on Jul. 3, 1997, now abandoned.

(51) Int. Cl.[7] ..... B24B 23/00

(52) U.S. Cl. ..... 451/350; 451/355; 451/356; 451/451; 15/931; 144/118

(58) Field of Search ..... 451/355, 356, 451/359, 451, 456, 350; 15/93.1, 236.1, 344, 415.1, 389, 385; 144/118, 919.1, 119.2, 252.1

(56) References Cited

U.S. PATENT DOCUMENTS 3,028,152 A * 4/1962 Scholl et al. ..... 451/350
3,613,147 A * 10/1971 Norfleet ..... 451/357
3,678,532 A * 7/1972 Boyd ..... 15/236
3,708,880 A * 1/1973 Norfleet ..... 30/172
4,488,383 A * 12/1984 Zerbe ..... 451/357
4,590,190 A * 5/1986 Yasui ..... 451/357
5,125,190 A * 6/1992 Buser et al. ..... 451/357
5,527,207 A * 6/1996 Azar et al. ..... 451/344
5,766,062 A * 6/1998 Edling ..... 451/451

* cited by examiner

*Primary Examiner*—George Nguyen
(74) *Attorney, Agent, or Firm*—M. K. Silverman

(57) ABSTRACT

A tool for the removal of paint and putty includes a semi-circular assembly housing including a semi-circular rigid collar. The tool also includes a disk-like abrading assembly rotatably and co-axially mounted within the semi-circular collar of the housing, the assembly including rigidly disposed abrading elements projecting both axially and radially, the assembly defining a plane of rotation. The tool further includes a motor for high speed rotation of the assembly, the motor located externally of the housing. The tool also includes bearings for establishing a fixed axial cutting depth relative to a primary work surface positioned thereagainst, in which the bearings function as a buffer between the abrading assembly and the work surface to thereby improve control and mobility of the assembly relative to the primary work surface. A platform is disposed between the assembly housing and the motor, in which the platform is preferably co-planer with the plane of rotation of the abrading assembly. The platform is rigidly secured to the motor. The tool yet further includes an element for tilting the assembly housing relative to the platform to expose a greater area of the abrading assembly to increase depth of cutting in an axial direction upon the primary work surface at that side of the abrading assembly which is tilted.

4 Claims, 9 Drawing Sheets

TOOL FOR THE REMOVAL OF PAINT-LIKE MATERIALS FROM WORK SURFACES

REFERENCE TO RELATED APPLICATIONS

This case is a continuation-in-part of application Ser. No. 09/315,832, filed May 21, 1999 now abandoned which is a continuation-in-part of application Ser. No. 08/888,275, filed Jul. 3, 1997 now abandoned, entitled Tool for Removal of Paint from Work Surface.

BACKGROUND OF THE INVENTION

The prior art of removal of paint, putty and the like from a work surface has, historically, consisted of various types of scraping means, as is reflected in U.S. Pat. No. 3,028,152 (1962) to Scholl, entitled Resurfacing Tool, U.S. Pat. No. 3,613,147 (1971) to Norfleet, entitled Wall Surface Scraper Tool and, secondarily, such patents as U.S. Pat. No. 3,604,520 (1971) to Shato, entitled Sonically Driven Paint Scraper; U.S. Pat. No. 3,722,022 (1973) to Falleson, entitled Rotating Paint Scraper; U.S. Pat. No. 3,731,338 (1973) to Walsh, entitled Mechanical Paint Scraper; U.S. Pat. No. 4,554,957 (1985) to Zayat, entitled Rotary Resurfacing Tool; U.S. Pat. No. 4,559,661 (1985) to Tsais, entitled Paint Scraper; and U.S. Pat. No. 4,485,349 (1989) to Demetrius, entitled Sander Paint Scraper.

For purposes of the present application, the most applicable references comprise said U.S. patents to Scholl and Norfleet. By way of illustration, salient portions of the structure of Norfleet are shown in FIGS. 1 and 2 herewith. It may therein be appreciated that the structure of Scholl is one intended for the treatment of delicate flat surfaces such as work surface 20 in which all paint and the like have already been removed. As such, Scholl is not designed for heavy duty abrading of old paint and putty, as is the inventive structure set forth herein. This primarily due to the fact that cutter blades 54 of Scholl are pivotally mounted upon pivot points 55, the purpose of which is to enable blades 54 of Scholl to rotate off of the work surface if they encounter excessive resistance there from. As such, it is to be appreciated that Scholl is intended as a planning or refinishing tool to create smooth surfaces that are then ready for refinishing, not to effect removal of layers of hardened old paint. As such, Scholl may be understood as a low power, low rpm device, while the within system is that of a high power, high rpm device.

Further, Scholl, to control depth of the cut, uses a system of rings 56 (see FIG. 1). The effect of which is to produce a marginal, i.e., less than two percent, change in the angle of the plane of rotation of cutting assembly 57 thereof. In addition, Scholl does not employ any form of buffering means between cutting elements 54 and the work surface 20. Accordingly, other than the location of edge 58 of the structure of Scholl, there exists no mean of control, during the operation Scholl, of the interface between the cutting assembly and the work surface 20. In addition, the structure of Scholl is unable to provide a scraping, abrading or cutting function to an integral secondary surface such as transverse surface 42 which is shown in FIG. 1, this due to the fact that the cutting assembly 57 of Scholl is entirely enclosed within the peripheral ring structure 56 thereof. As such, no form of cutting outside of the periphery of ring structure 56 is possible.

With regard to the structure of Norfleet, the same is generally shown in the view of FIG. 3. Therefrom, it may be appreciated that the only form of control of depth that exists lies in the use of rollers 59 and slidable adjustment of the depth of cutting elements 60 thereof. As such, it is necessary to manually adjust each of these cutting elements (typically four in number) in order to adjust the depth of the cut relative to primary work surface 20. Apart from the above, the Norfleet gives rise to safety issues in that no housing or shroud exists about cutting assembly 61 thereof, such that material removed from the surface 20 will be uncontrollably ejected from the work surface, thereby generating hazardous dust and debris in the work area. Further, Norfleet, like Scholl, does not include any capability for simultaneously removing paint, putty and the like from an integral transverse secondary surface such as surface 42. In fact, due to the offset from cutting element 60 created by rollers 59, it is unlikely that the structure of Norfleet could effect any removal of material from the secondary surface 42.

In general terms, much of the offset prior art suffers from a lack of effectiveness in the desired function of paint removal as, particularly, is the case with sonically operated devices such as Sheeto.

Those paint removal devices of the rotating type are generally unacceptable for use upon any fine or quality work surface in that they create excessive gouging during the process of paint removal. In other words, in such devices, although the paint may be removed, the underlying work surface is so damaged that a repair of that surface is necessary before any painting can begin.

Other paint removal devices comprise in effect glorified sanding machines and, as such, make no contribution to the art of tools for paint removal. That is, sanding devices, when used for the purpose of paint removal, are only able to remove paint in a uniform fashion to a certain depth. Also, damage to the underlying wood, beneath the paint, is generally inevitable as is the creation of ridges within the wood caused by the edges of the reciprocating sanding tool. Other devices, such as that reflected in Zayat above, have application only to work surfaces of a particular geometry, e.g., shingles or clap boards in the case of Zayat.

There has accordingly long existed a need in the art for a power tool useful in the removal of paint from a work surface that will not damage the work surface, will function efficiently, is applicable to a variety of pipes and thicknesses of paint, and which can be integrated with state of the art vacuum debris removal means which are now an OSHA requirement with many industrial power tools.

The instant invention may therefore be viewed, as a response to the above long-felt need in the art.

SUMMARY OF THE INVENTION

The present tool for the removal of paint and putty includes a semi-circular assembly housing including a semi-circular rigid collar secured thereto. The tool also includes a disk-like abrading assembly rotatably and co-axially mounted within said semi-circular collar of said housing, said assembly including rigidly disposed abrading elements projecting both axially and radially therefrom, said assembly defining a plane of rotation. The inventive tool further includes a motor for high-speed rotation of said assembly, said motor located externally of said housing. The present tool also includes bearing means for establishing a fixed axial cutting depth relative to a primary work surface positioned thereagainst, in which the bearing means function as a buffer between said abrading assembly and said work surface to thereby improve control and mobility of said assembly relative to the primary work surface. A platform is disposed between said assembly housing and said motor, in which said platform is preferably co-planer with said plane of rotation of the abrading assembly. Said platform is rigidly secured to said motor. The inventive tool yet further includes means for tilting said assembly housing relative to said platform to thereby expose a greater area of said abrading assembly to increase depth of cutting in an axial direction upon the primary work surface at that side of said abrading assembly which is tilted thereby. The instant tool yet further includes means for selectably increasing the effective polar dimension of said semi-circular assembly housing to correspondingly decrease radial projection of radial cutting surface of said abrading element relative to a virtual circumference defined by an open polar segment of the semi-circular assembly housing.

It is accordingly an object of the invention to provide a power tool for the efficient removal of paint and putty from integral transverse work surfaces.

It is another object to provide a tool of the above type capable of removing paint from work surfaces without damage to the wood or other material beneath the paint thereon.

It is a further object of the invention to provide a tool of the above type in which the degree of abrasion or cutting of the paint upon the work surface can be regulated through control of both the axial position of the abrading elements and of a buffer means surrounding the same.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 4A:
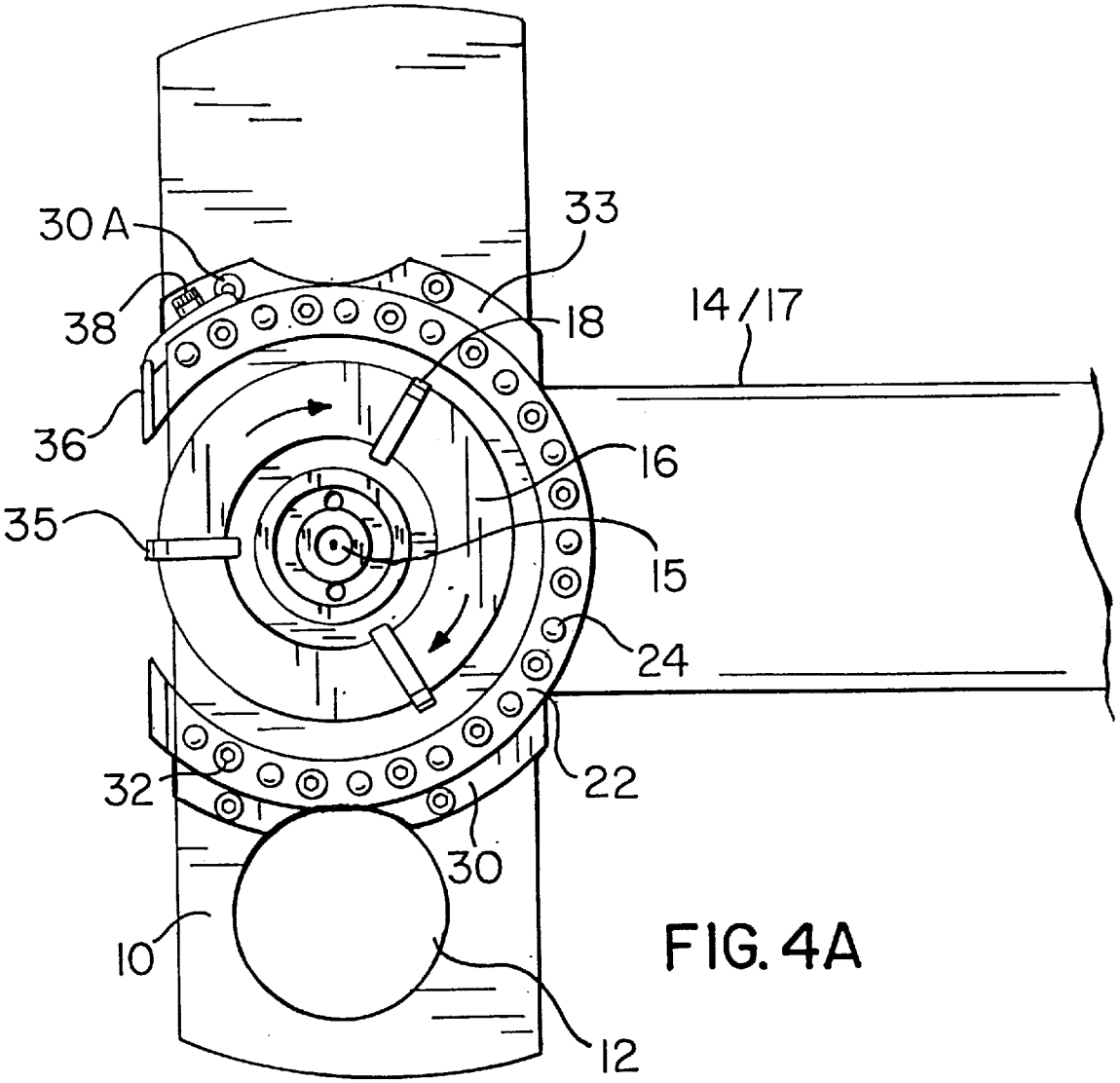
FIG. 4A is a bottom plan view of the inventive tool disclosed herein.
Figure 4B:
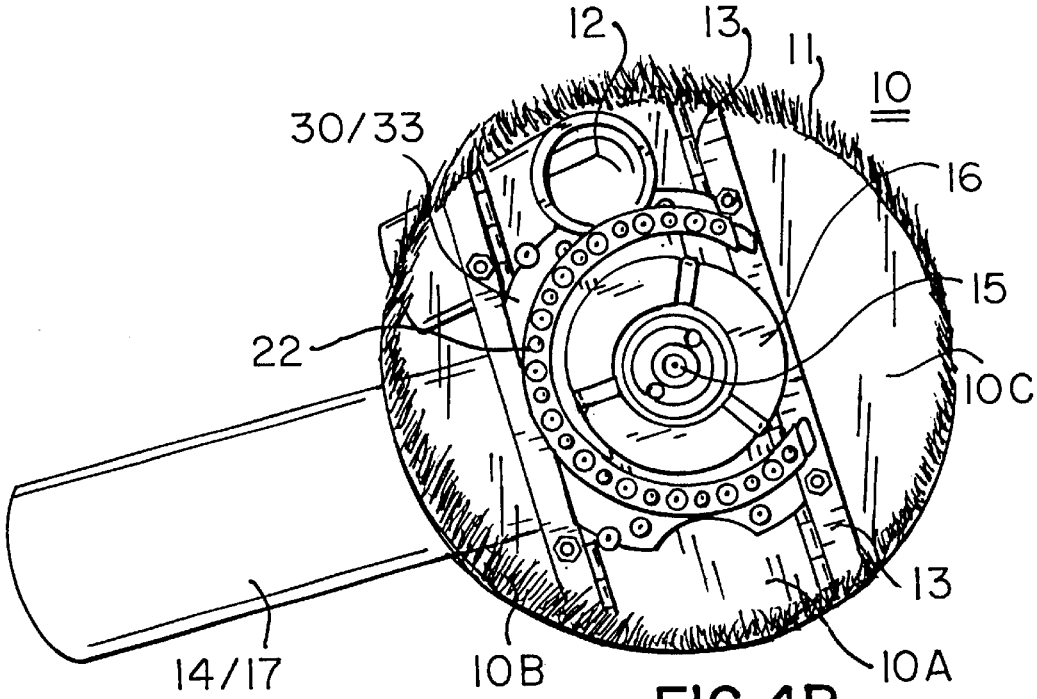
FIG. 4B is a bottom perspective view of the inventive tool inclusive of the associated dust and debris shroud.
Figure 4C:
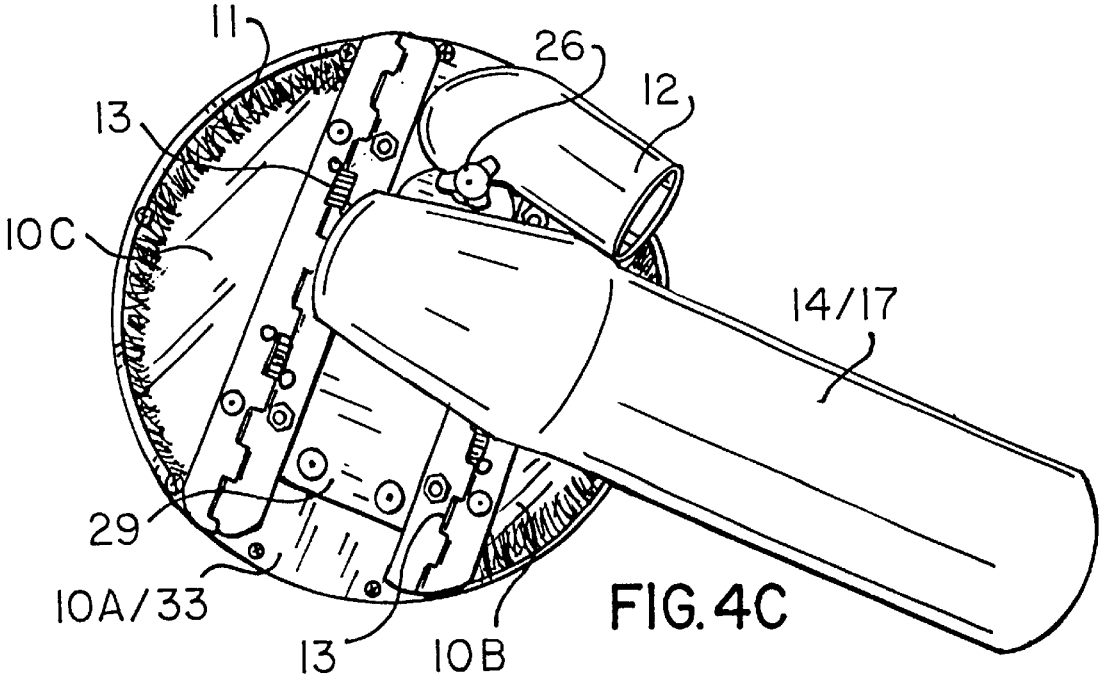
FIG. 4C is a top perspective view of the tool and shroud of FIG. 4B.
Figure 5:
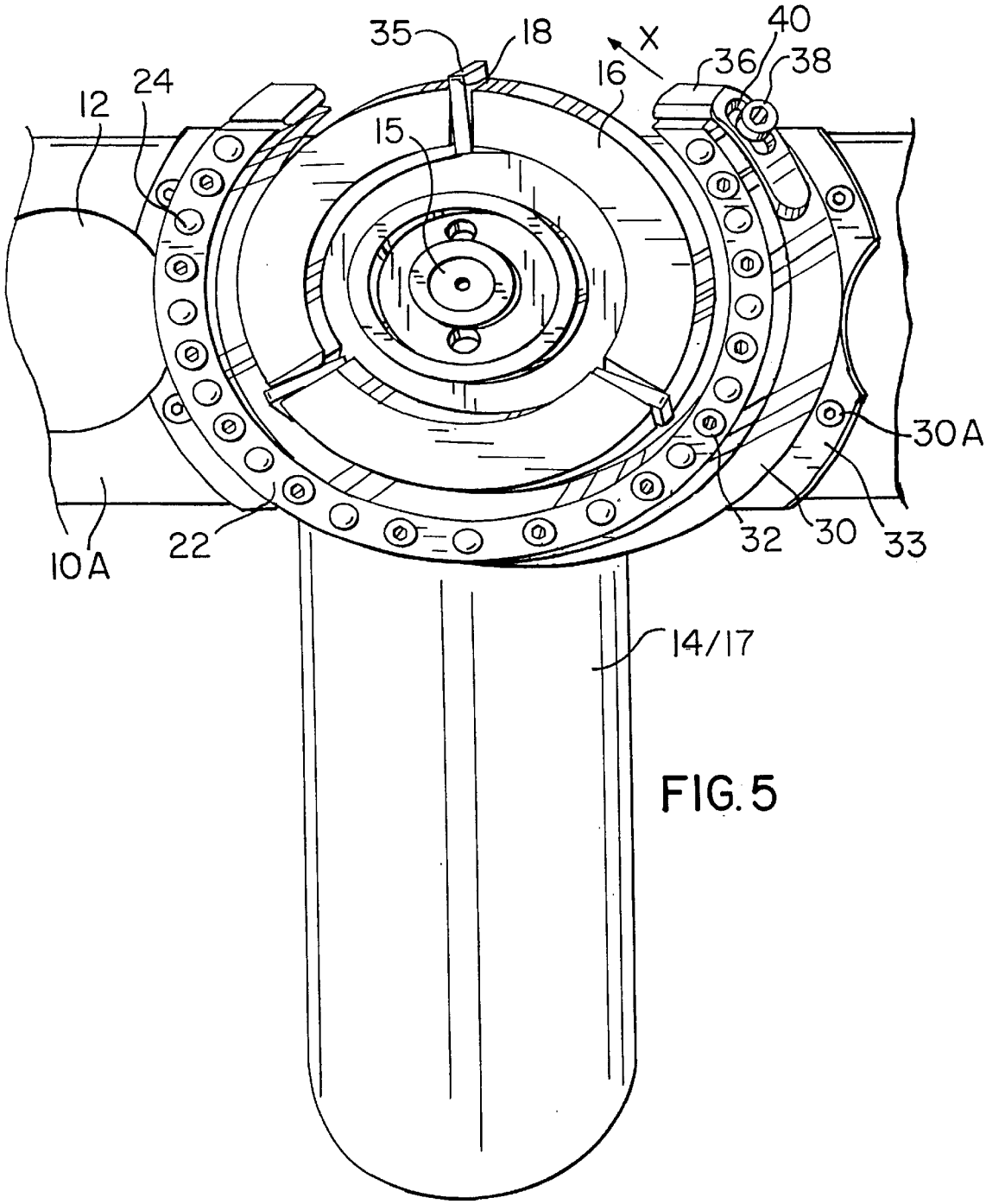
FIG. 5 is a bottom perspective view thereof.

With reference to the bottom plan view of FIGS. 4A and 4B, the top view of FIG. 4C, and the bottom view of FIG. 5, there may be seen a circumstantial vacuum shroud 10 and its associated vacuum conduit 12 (both more fully described in my U.S. Pat. No. 5,709,597, the specification of which is incorporated by reference), the purpose of which is to prevent the escape of debris and dust associated with the paint and putty removal process into the ambient environment. Shroud 10 comprises a rigid central panel 10A, with which conduit 12 communicates, and transparent outer flaps 10B and 10C which are secured to central panel 10A by spring-biased hinges 13. Lateral brushes 11 (or equivalent means) preclude escape of debris and dust.

Figure 6:
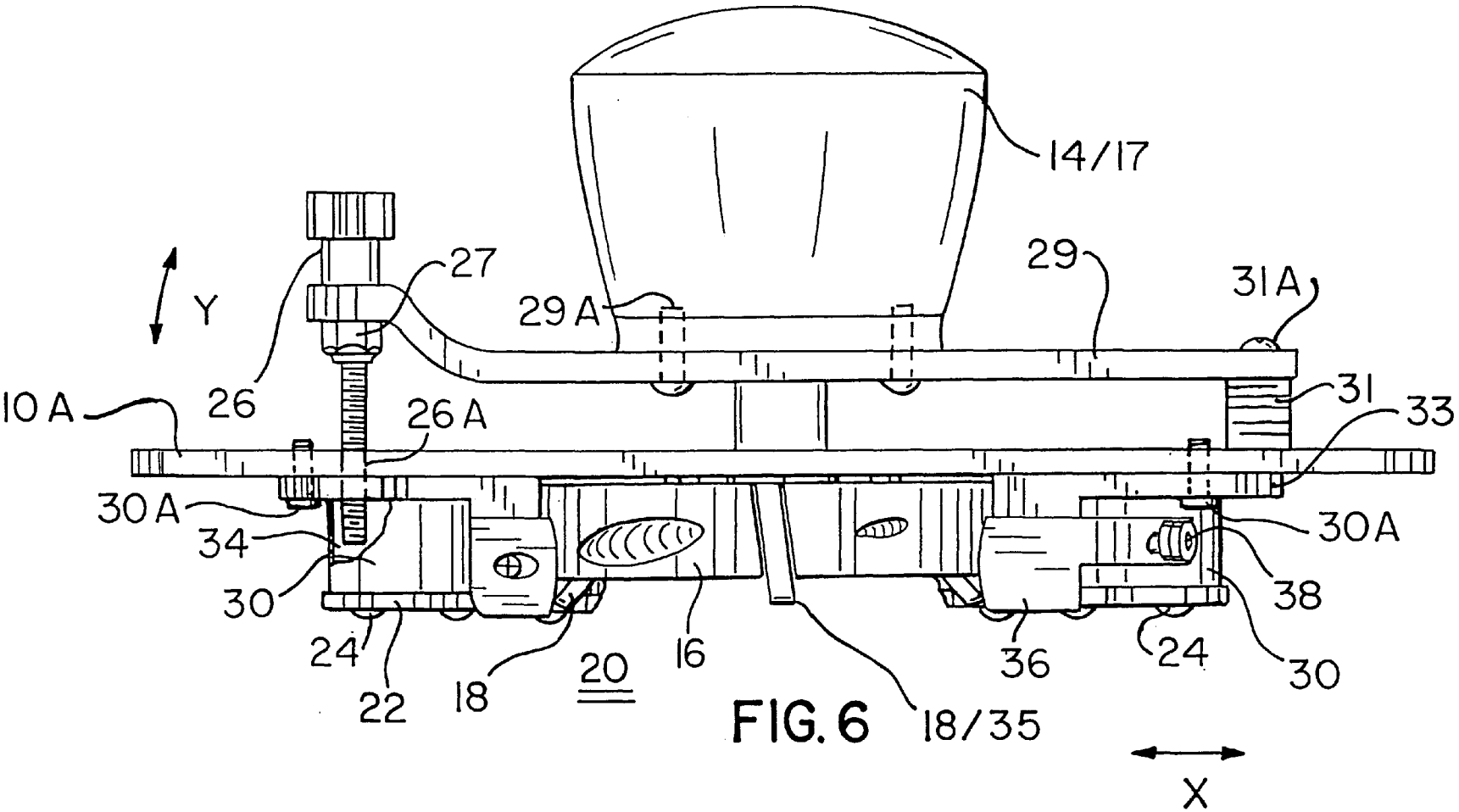
FIG. 6 is a front elevational view showing the elements of the inventive from the direction of the open portion of the semi-circular assembly housing and rigid collar thereon.
Figure 8:
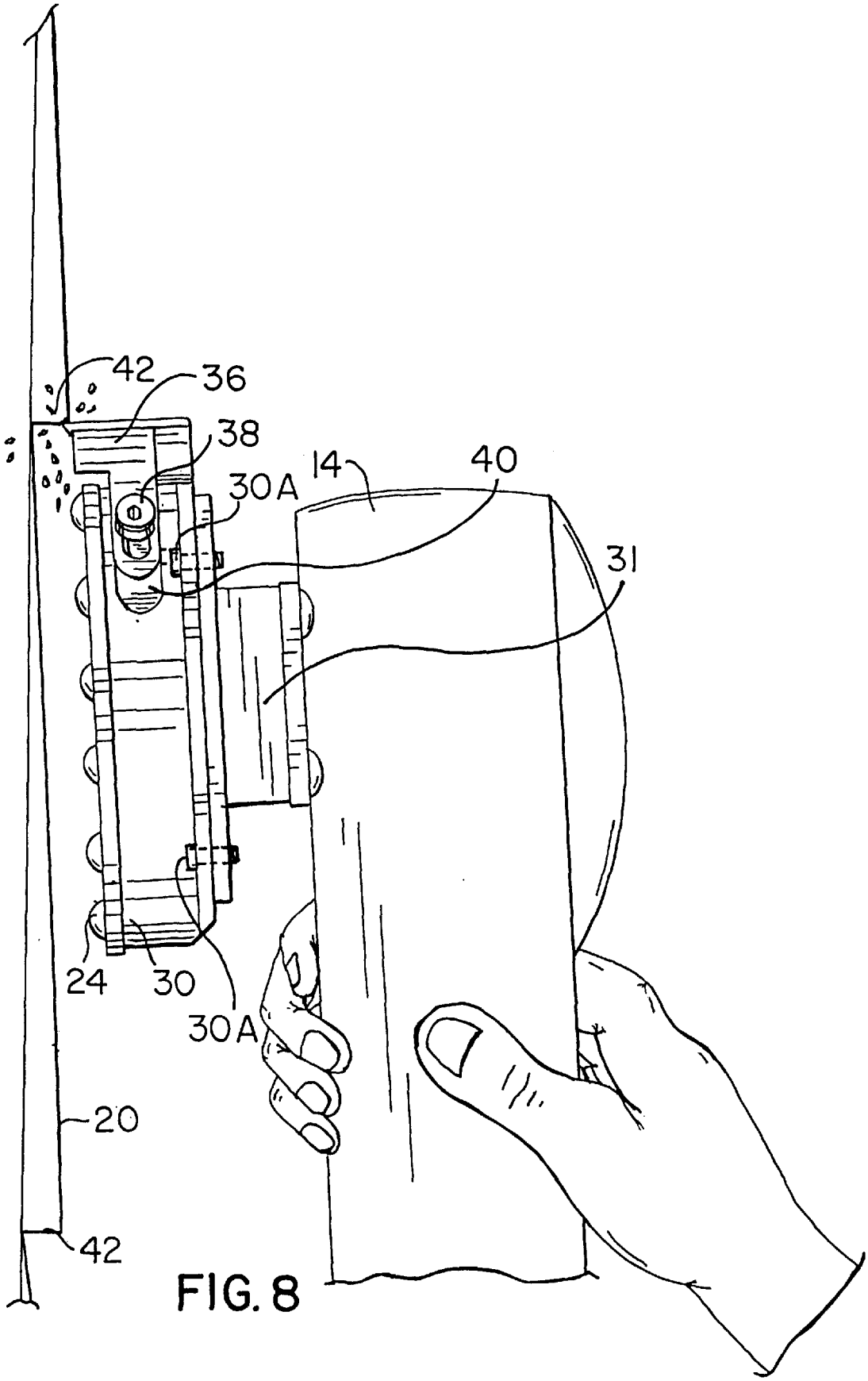
FIG. 8 is an operational view showing the usage of the inventive tool to remove paint, putty and the like from an integral transverse secondary work surface.

Further shown in FIGS. 4 and 5 is a handle 14 and rotational output shaft 15 of a motor 17 (see also FIG. 6). Said rotational output 15 is in integral communication, that is, comprises a rotational input to a disk-like abrading assembly 16 which includes a plurality of rigidly disposed abrading elements 18 which project both axially and radially from the abrading assembly. The axial projections of the abrading elements 18 are in the direction of a primary work surface 20 (see FIG. 8), while radial projections therefrom are in the direction of a work surface integral 42 transverse to said primary surface, as is more fully described below. Said abrading assembly 16 defines a plane of rotation of the system.

Disposed about the disk-like abrading assembly 16 is a semi-circular assembly housing 30 which includes a back surface 33 and a semi-circular rigid collar 22 which is secured thereon. Assembly housing 30 with its back surface 33 and semi-circular rigid collar 22 are secured to central panel 10A by screw 30A. See FIGS. 5 to 6B. Within said collar 22 is disposed a plurality of ball bearings 24 which function as a buffer between abrading assembly 16 and primary work surface 20 to thereby provide control and mobility of both the assembly 16 and the entire tool relative to the primary work surface.

Figure 6A:
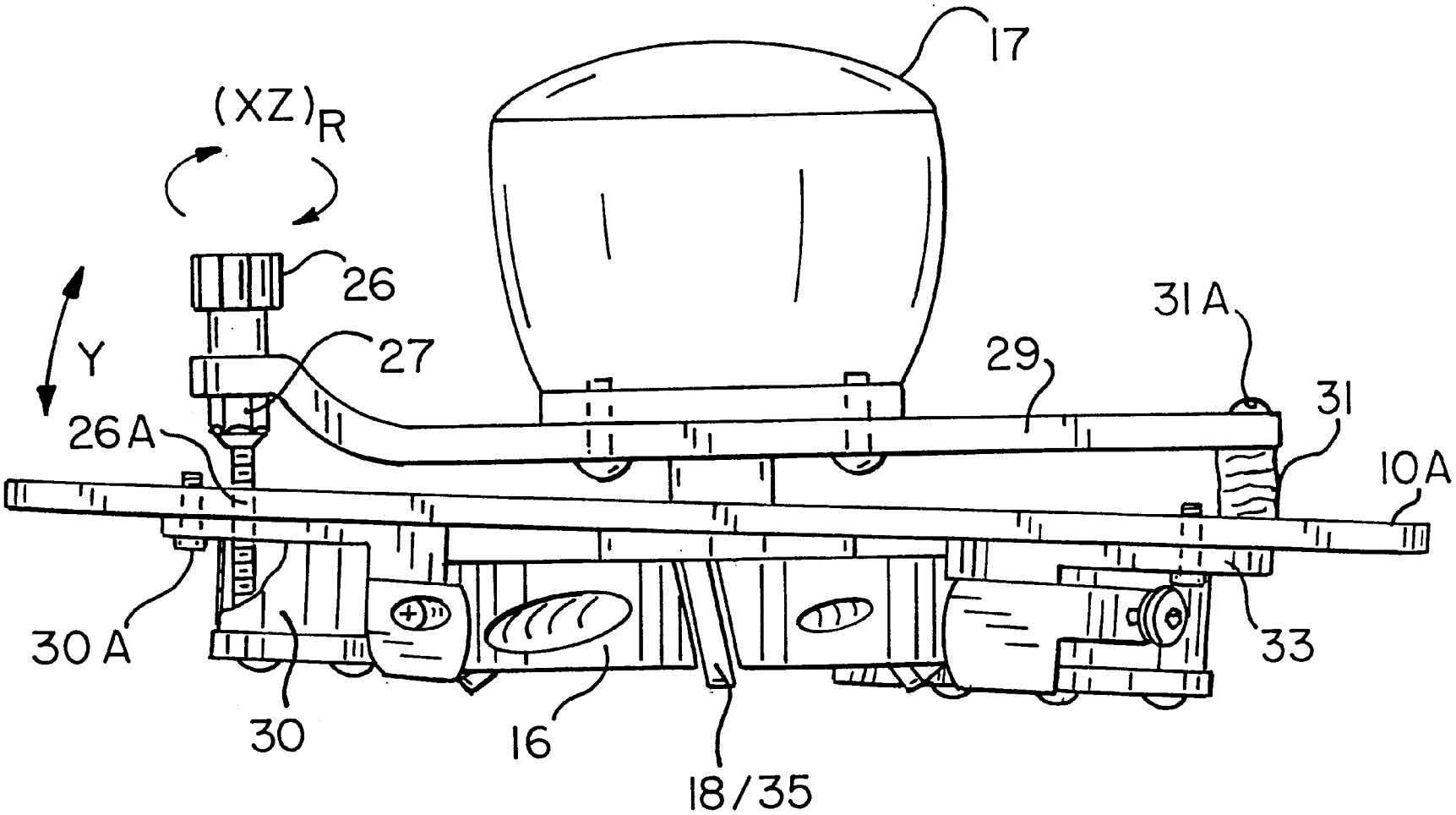
FIG. 6A is a front elevational view similar to that of FIG. 6 however showing adjustability of the plane of the abrading assembly relative to the plane of the motor.
Figure 6B:
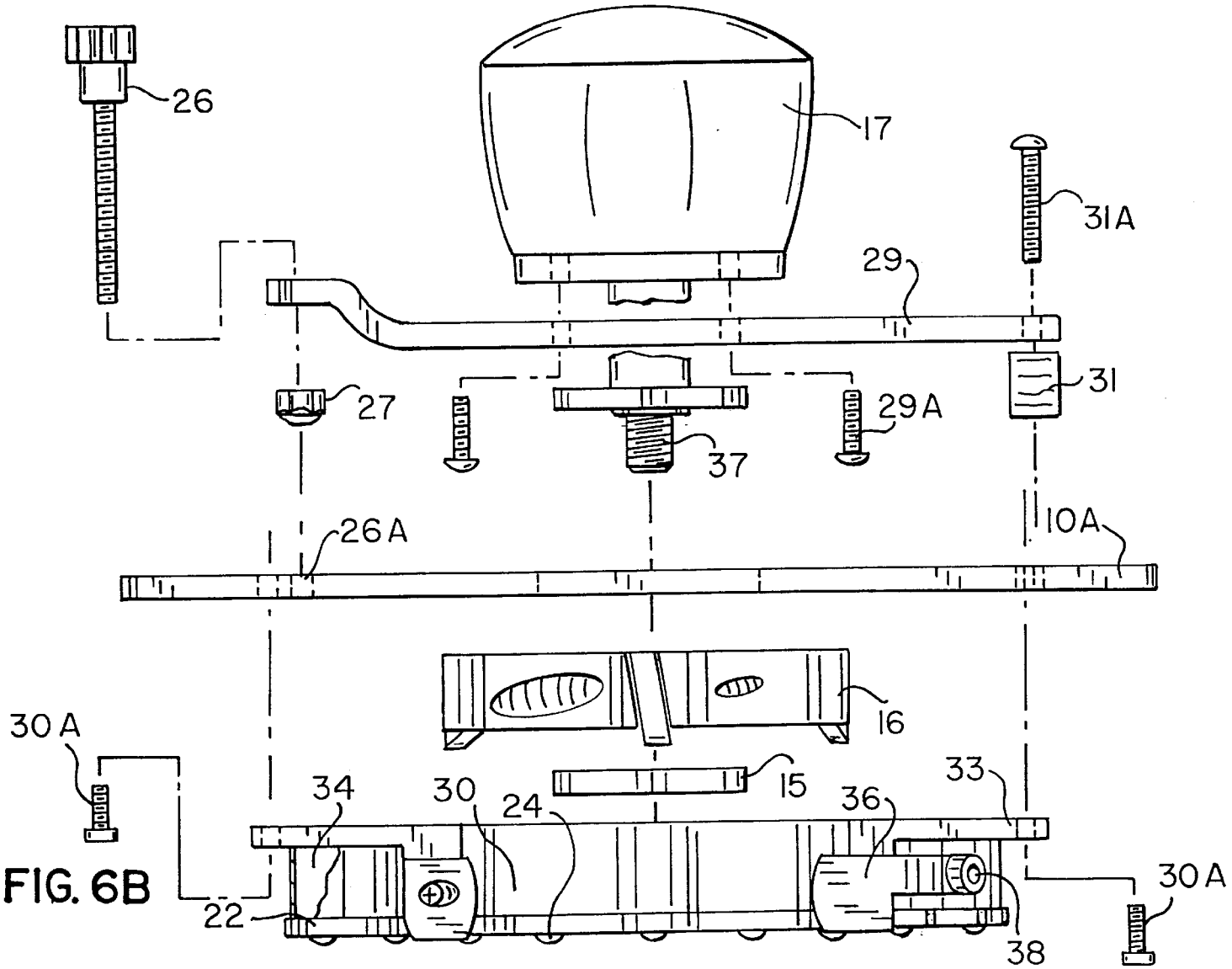
FIG. 6B is an exploded view of the system shown in FIG. 6.

As may be noted in FIGS. 6 and 6A, a platform 29 is disposed between said back surface 33 of the assembly housing 30 and the motor 17, wherein said platform 29 is, in the absence of adjustment, preferably parallel with said plane of rotation of the abrading assembly. As may be further noted in FIGS. 6 thru 6B, said platform 29 is rigidly secured to said motor 17 by screws 29A and flexibly secured to central panel 10A thru the use of resilient offset and pivot means 31. Screw 31A extends thru platform 29, pivot means 31 and panel 10A, to assure stability of said resilient means 31 within the system.

It is to be appreciated that the function of ball bearings 24 within semi-circular collar 22 is to permit the housing assembly 30 to interface against the primary work surface 20 at an axial offset that will limit contact between abrading elements 18 and the work surface to a depth that will remove paint and putty without unnecessarily damaging the underlying work surface. Further, the bearings 24 enable the instant tool to readily slide over work surface 20 with a minimal amount of friction and drag, this as compared to high drag devices which characterize the prior art.

Figure 1:
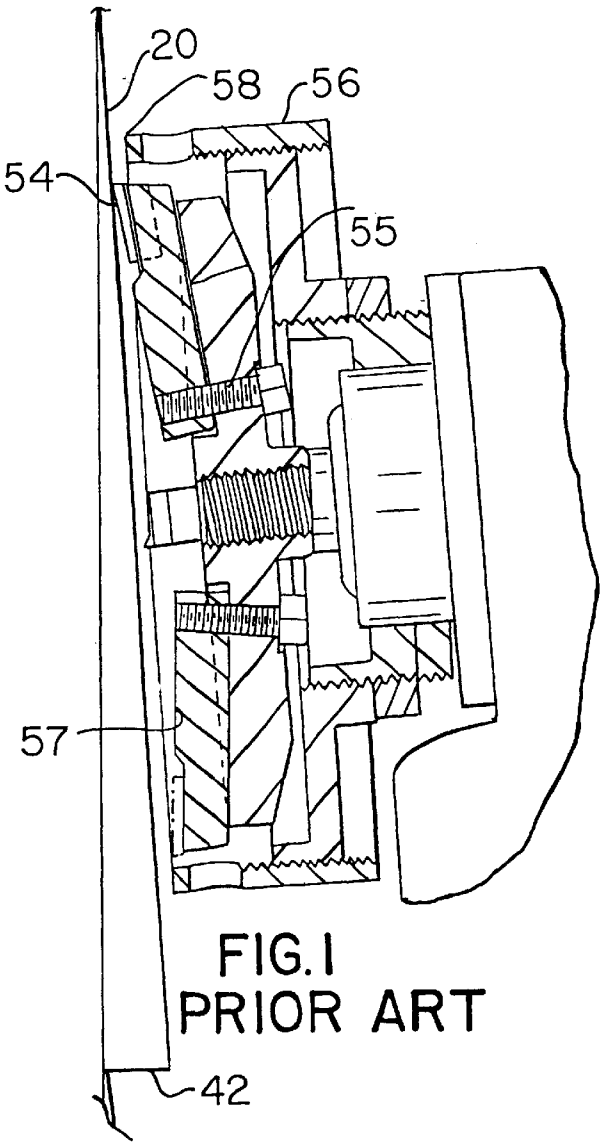
FIG.1 PRIOR ART
FIGS. 1 and 2 are schematic views of the prior art of Scholl.
Figure 2:
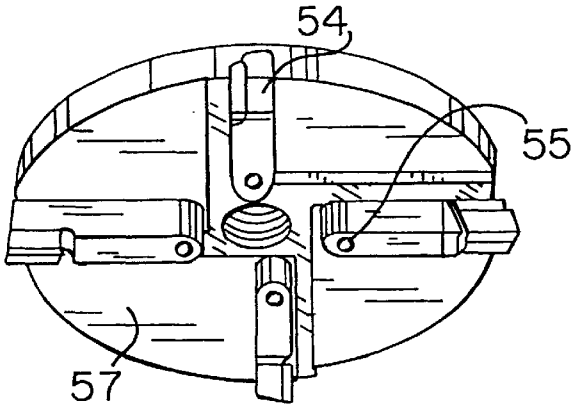
FIG.2 PRIOR ART
Figure 3:
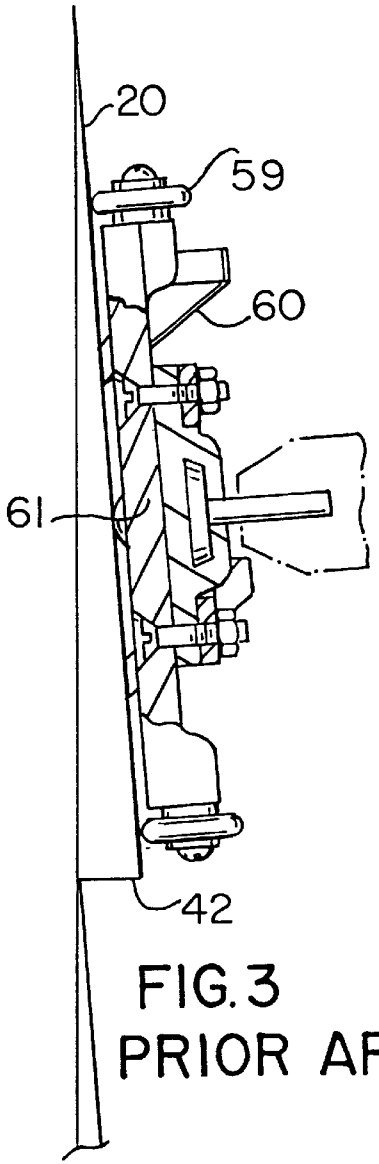
FIG. 3 PRIOR ART
FIG. 3 is a schematic view of the prior art of Norfleet.
Figure 7:
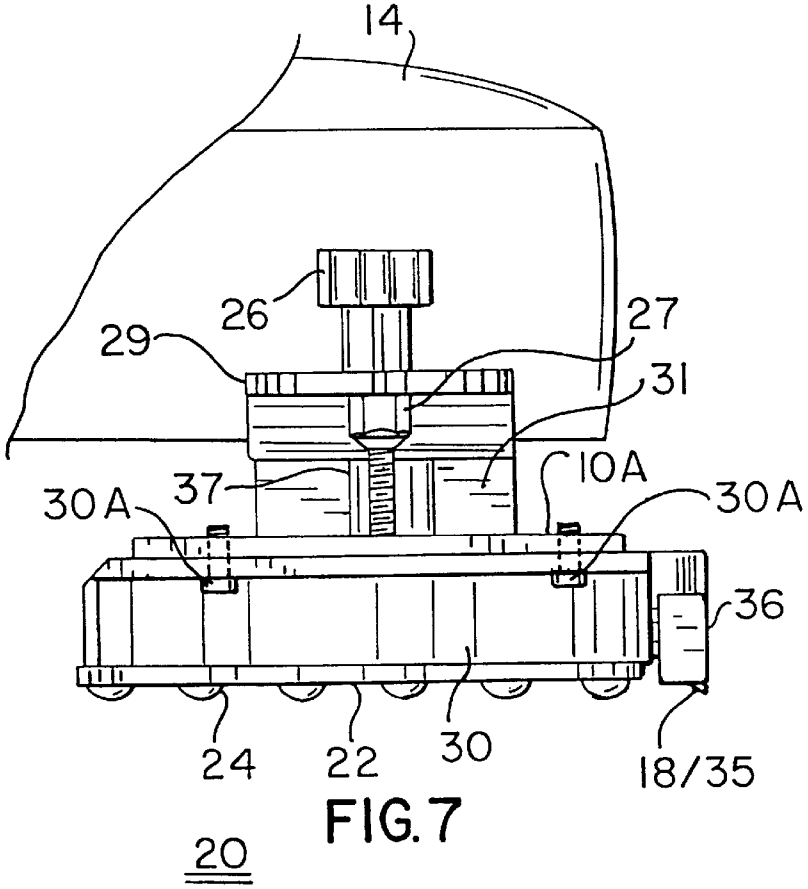
FIG. 7 is a side elevational view of the view of FIG. 6.

With further reference to FIGS. 6, 6A and 7, it is noted that there is provided a depth control screw 26, rotatable in plane (XZ)R, within said platform 29, and extending thru channel 26A of panel 10A, the function of which is to press against or pull said back surface 33 of assembly housing 30 to effect a tilt of the plane of platform 29 and, with it, the plane of integrally disposed semi-circular collar 22 by an arc segment designated by the letter "Y" in FIGS. 6 and 6A. Screw 26 is stabilized by a control washer 27. By such adjustment, an increase in exposure of up to about ten degrees of one side of the plane of rotation of the abrading assembly relative to the plane of said platform 29 may be attained. This tilt is also enabled by the flexibility of said offset means 31. Accordingly, there is defined means for tilting of the assembly housing 30, together with its constitute elements, namely, collar 22 and abrading assembly 16, relative to the plane of platform 29 which is normal to the axis of rotation of motor output shaft 15, this to increase the depth of cutting in, and axial direction against, said primary work surface 20 upon that side of the abrading assembly which is so tilted. In other words, the axial projection of the abrading elements 18 at one side of assembly housing 30 is effectively increased by the tilting action of control screw 26, when rotated in said plane (XZ)R, this while maintaining, without change of plane of rotation, the operation of the abrading assembly 16. This feature has been found to be of value in increasing the rotational cutting, scraping or abrading effects of the abrading assembly or, if desired, decreasing the same to effectively address situations of particular paint thickness or thinness, that is, number of coats of paints, and type of paint or material to be removed from the work surface 20. Stated otherwise, the thicker or denser the paint layers to be removed from work surface 20, the greater the tilt of the collar 22 which will be effected by the operation of control screw 26 against both panel 10A and surface 33 of assembly housing 30. See FIGS. 4B and 6A. Conversely, if the layers of paint to be removed from surface 20 are very thin, it will be unnecessary to advance control screw 26 against the assembly housing 30, and it may be accessory to retract control screw 26.

It is to be understood that mechanical means, other than screw 26, may be employed to equivalently shift the plane of housing 30 relative to the axis of abrading assembly 16.

With reference to FIGS. 4 and 5, it is noted that both the assembly housing 30 and the within semi-circular collar 22 will typically subtend an angle of about 290 degrees, this to facilitate the below-described radial cutting capability of the tool. Further, it is to be appreciated that the function of Alan Head screws 32 is both to hold in place said ball bearings 24 and to mount semi-circular collar 22 to housing assembly 30. As above noted, collar 22 with ball bearings 29 function as a buffer between abrading elements 18 and primary work surface 20.

With further reference to FIGS. 5 thru 8, there is shown a control element 36 which is slidably adjustable within recess 40 disposed within an exterior of housing 30 of the semi-circular collar 22. The function of control 36 is, as may be appreciated with particularly reference to FIGS. 4A and 8, that of regulating the radial cutting extent of axial surfaces 35 of the abrading elements 18 against a transverse work surface 42. In other words, through the selectable adjustment of control 36 using said screw 38, the effective polar dimension of the semi-circular rigid collar 22 may be increased or decreased to thereby respectively decrease or increase the effective radial projection of the radial cutting surfaces 35 of the abrading elements 18 within a virtual circumference defined by an open polar segment of approximately 70 degrees, as shown in FIGS. 4A and 5. This adjustment is also shown by the Letter X in FIGS. 5 and 6. The significance of this capability may be appreciated with reference to FIG. 8 in which is shown a typical work environment of the present inventive tool, the same consisting of a primary work surface 20 and, substantially normally thereto, said transverse work surface 42 in the nature of an overhang or lip of a shingle. In such a work environment, it is essential that a tool be able to concurrently remove paint or other material from both a primary and an integrally transverse work surface. In the absence of such capability, it would be necessary to employ a different or additional tool to effect paint or material removal from the transverse surface 42. See FIG. 8. Accordingly, by virtue of the above means for selectable change of the effective polar dimension X of the collar 22. See FIGS. 5 and 6. One can thereby effect material removal from the transverse surface 42 while acting against primary surface 20. Such capability, as above described in the Background of the Invention, does not exist in any art of record know to the within inventor. As such, a single abrading assembly, namely, abrading assembly 16, is able to simultaneously effect material removal from both said primary surface 20 and said integrally transverse dependent work surface 42.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. A tool for the removal of paint and putty from a primary work surface, the tool comprising:

(a) an outer semi-circular assembly comprising circumferential sidewalls, an integral radial backplate, and a semi-circular rigid collar secured therein;

(b) rigid disk-like abrading means rotatably and co-axially mounted within said rigid collar of said outer assembly, said abrading means including rigidly disposed abrading elements projecting both axially and radially from a periphery thereof, said abrading means defining a plane of rotation;

(c) a motor having an output for high speed rotation of said abrading means, said motor located externally of said assembly;

(d) within said rigid collar and in a direction axially opposite of said motor, bearing means for establishing a fixed axial cutting depth relative to said primary work surface, and said bearing means positionable thereagainst, in which said bearing means function as an axial buffer between said abrading means and said work surface and to improve control and mobility of said tool relative thereto;

(e) an elongate platform pivotally secured, at one end thereof to said back plate of said outer assembly, said platform normally parallel with said plane of rotation of said abrading means, said motor rigidly secured to a surface of said platform opposite that of said outer assembly; and (f) between said platform and outer assembly, means for tilting said assembly relative to said platform to tilt said plane of rotation of said abrading assembly and to thereby vary depth of cutting thereof in an axial direction upon said primary work surface at that end of said outer assembly at which said tilting means is situated.

2. The tool as recited in claim 1, further comprising:

affixed to a polar end of said rigid collar, means for selectably increasing the effective polar dimension of said semi-circular assembly to correspondingly vary the effective radial projection of radial cutting surfaces of said abrading elements relative to a virtual circumference defined by an open polar segment of said semi-circular assembly and rigid collar thereof, whereby the extent of radial cut, against a work surface transverse to said primary work surface, of said abrading elements may be modified by said means for selectably increasing the effective polar dimension of said semi-circular assembly.

3. The tool as recited in claim 2 further comprising:

a vacuum defining dust and debris shroud surrounding said assembly housing and disposed integrally and concentrically about said assembly housing.

4. The tool as recited in claim 3 further comprising:

vacuum exhaust means in integral communication with said dust and debris shroud.

* * * * *